US006191094B1

(12) United States Patent
Cala et al.

(10) Patent No.: US 6,191,094 B1
(45) **Date of Patent: *Feb. 20, 2001**

(54) AQUEOUS CLEANING COMPOSITION FOR CLEANING SUBSTRATES AND METHOD OF USING SAME

(75) Inventors: Francis R. Cala, Highland Park, NJ (US); Richard A. Reynolds, Smyrna, GA (US)

(73) Assignee: Church & Dwight Co., Inc., Princeton, NJ (US)

( * ) Notice: Under 35 U.S.C. 154(b), the term of this patent shall be extended for 0 days.

This patent is subject to a terminal disclaimer.

(21) Appl. No.: 09/186,273

(22) Filed: Nov. 5, 1998

Related U.S. Application Data

(63) Continuation of application No. 08/851,849, filed on May 6, 1997, now Pat. No. 5,866,528.

(51) Int. Cl.[7] ..... C11D 1/94; C11D 1/72; C11D 3/10

(52) U.S. Cl. ..... 510/423; 510/245; 510/254; 510/433; 510/435; 510/499

(58) Field of Search ..... 510/245, 254, 510/423, 433, 435, 499; 134/38, 42

(56) References Cited

U.S. PATENT DOCUMENTS

| | | | | |
|---|---|---|---|---|
| 3,865,754 | | 2/1975 | Norris et al. | 510/348 |
| 3,951,879 | | 4/1976 | Wixon | 510/330 |
| 4,414,128 | * | 11/1983 | Goffinet | 510/405 |
| 4,544,494 | | 10/1985 | Downey et al. | 510/340 |
| 4,549,977 | | 10/1985 | Joshi et al. | 8/137 |
| 5,158,710 | | 10/1992 | VanEenam | 510/264 |
| 5,190,747 | | 3/1993 | Sekiguchi et al. | 424/56 |
| 5,411,585 | | 5/1995 | Avery et al. | 106/287.1 |
| 5,827,815 | * | 10/1998 | Cala et al. | 510/509 |
| 5,866,528 | * | 2/1999 | Cala et al. | 510/423 |
| 5,919,745 | * | 7/1999 | Cala et al. | 510/340 |

* cited by examiner

*Primary Examiner*—Gregory R. DelCotto
(74) *Attorney, Agent, or Firm*—Irving M. Fishman

(57) ABSTRACT

An alkaline aqueous cleaning composition for cleaning a substrate contaminated with industrial-type soil contaminants contains (i) an aqueous portion and (ii) an active-ingredient portion composed of (A) an alkalinity-providing agent and (B) a surfactant mixture containing (a) an active concentration of an ethoxylated $C_{12-14}$ alkanol surfactant having an HLB value at 25° C. of from 8 to 12 and (b) an active concentration of at least one aminocarboxylic acid surfactant of the general formula R—N(H)—R', wherein R is a straight or branched chain aliphatic organic group having from 10 to 20 carbon atoms, and R' is a straight or branched chain carboxylic acid having from 1 to 7 carbon atoms. At an active-concentration ratio of surfactant (a) to surfactant (b) of about 2.5:1, the surfactants have a synergistic effect on the cleaning composition's ability to remove certain types of industrial-soil contaminants. Cleaning of the substrate with the aqueous cleaning composition involves contacting the substrate with the composition for a period of time sufficient to remove at least a substantial portion of the contaminants from the substrate.

34 Claims, No Drawings

AQUEOUS CLEANING COMPOSITION FOR CLEANING SUBSTRATES AND METHOD OF USING SAME

This application cont. of application Ser. No. 80/851,849, filed May, 6, 1997, now U.S. Pat. No. 5,866,528 entitled "AQUEOUS CLEANSING COMPOSITION FOR CLEANING SUBSTRATES AND METHOD OF USING SAME" which application is hereby incorporated by reference.

BACKGROUND OF THE INVENTION

This invention relates to an aqueous cleaning composition and to a method of using same to clean substrates. More particularly, this invention relates to an alkaline, aqueous cleaning/degreasing composition containing a particular combination of surfactants and to a method of using such composition to remove industrial-type soils from substrate surfaces.

Many industries, such as, for example, automobile parts repair and replacement services and the like, require that component mechanical parts be cleaned prior to inspection, repair, or replacement thereof. Generally, such parts have been exposed to various contaminants such as dirt, grease, oil, ink and the like, which must be removed for effective repair or service.

A variety of metal cleaners have been used to clean such mechanical parts. For example, solvent-based metal cleaners have been used which contain either halogenated or non-halogenated hydrocarbons. Aqueous-based, highly alkaline detergent systems have also been used to clean metal parts. However, the use of such solvent-based or aqueous-based cleaners has raised environmental and/or worker safety concerns.

For example, although halogenated hydrocarbon solvents such as chlorofluorocarbons (CFCs), trichloromethane, methylene chloride and trichloroethane (methyl chloroform) have been widely used in industry for metal cleaning, the safety, environmental and cost factors associated with their use coupled with waste disposal problems are negative aspects of the use of such solvents. A world-wide and U.S. ban on most halogenated solvents is soon in the offing by virtue of the Montreal Protocol, Clean Air Act and Executive and Departmental directives.

Non-halogenated hydrocarbon solvents such as toluene, Stoddard solvent and like organic compounds such as ketones and alcohols are generally flammable and highly volatile and have dubious ability to be recycled for continuous use. These factors, along with unfavorable safety, environmental and cost factors, make the non-halogenated hydrocarbon solvents unattractive for practical consideration. For example, the most useful organic solvents, classified as volatile organic compounds (VOCs), pollute the atmosphere, promote formation of a toxic zone at ground level, and add to the inventory of greenhouse gases.

Aqueous cleaning systems have been developed to overcome some of the inherent negative environmental and health aspects associated with the solvent-based cleaning systems. Unfortunately, aqueous cleaning systems also have drawbacks.

For example, aqueous cleaners containing sodium hydroxide or organic solvents such as alkanolamine, ethers, alcohols, glycols and the like, tend to be exceedingly alkaline, i.e., having pHs of 13 and above. These exceedingly alkaline aqueous solutions are highly corrosive to metal surfaces, highly toxic and can be dangerous to handle, thus requiring extreme safety measures to avoid contact with the skin. The organic solvent-containing aqueous cleaners have the toxicity and environmental problems discussed previously herein.

Although the exceedingly alkaline aqueous cleaners have the aforementioned drawbacks, it has been most difficult to obtain an aqueous detersive solution which has a moderate pH (i.e., less than about 12.0) and which is effective in removing grease and oil contaminants from metal substrates, e.g., metal engine parts, and which would not be corrosive to the metal substrates.

A primary object of this invention is to provide an alkaline aqueous cleaning composition which has a moderate pH and which effectively removes industrial-type soil contaminants from substrates.

Another object of this invention is to provide an alkaline aqueous cleaning composition having a moderate pH and which effectively removes industrial-type soil contaminants from a metal substrate without being excessively corrosive to the metal substrate.

A further object of this invention is to provide an alkaline aqueous cleaning composition having a moderate pH and which effectively removes industrial-type soil contaminants from a substrate, wherein the cleaning composition is not irritating to human skin and is less toxic upon accidental ingestion than are organic-based solvent systems.

Still another object of this invention is to provide a method of cleaning substrates by means of an alkaline aqueous cleaning composition having the properties described in the foregoing objects.

These and other objects which are achieved according to the present invention can be readily discerned from the following description.

SUMMARY OF THE INVENTION

The present invention is based in part on the discovery that the presence in an alkaline aqueous composition of a surfactant mixture composed specifically of an ethoxylated $C_{12-14}$ alkanol surfactant having an HLB at 25° C. of from 8 to 12 and at least one aminocarboxylic acid surfactant of formula (I) hereinbelow will provide the aqueous alkaline composition with excellent cleaning abilities, particularly with respect to removing industrial-type soil contaminants from substrates such as plastic and metal substrates. This is true even when the aqueous alkaline composition is moderately alkaline.

The present invention is further based on the discovery that at a particular active-concentration ratio relative to one another, the ethoxylated $C_{12-14}$ alkanol surfactant and the aminocarboxylic acid surfactant will have a synergistic effect on the industrial-soil removing properties of the aqueous cleaning composition.

Accordingly, one aspect of the present invention is directed to an aqueous alkaline cleaning composition for cleaning a substrate contaminated with industrial-type soil contaminants, containing:

(i) an aqueous portion and (ii) an active-ingredient portion composed of:

(A) an alkalinity-providing agent in an amount sufficient to provide the aqueous cleaning composition with an alkaline pH;

(B) a surfactant mixture containing (a) an active concentration of an ethoxylated $C_{12-14}$ alkanol surfactant having an HLB value at 25° C. of from 8 to 12, and (b) an active concentration of at least one aminocarboxylic acid surfactant of the general formula:

$$R—N(H)—R' \quad (I)$$

wherein R is a straight or branched chain aliphatic organic group having from 10 to 20 carbon atoms, preferably from 12 to 18 carbon atoms, and R' is a straight or branched chain carboxylic acid having from 1 to 7 carbon atoms, preferably from 2 to 4 carbon atoms;

wherein the active concentration of surfactant (a) and the active concentration of surfactant (b) are such as to render the aqueous cleaning composition capable of removing at least a substantial portion of the contaminants from the substrate.

A further aspect of this invention is directed to a non-aqueous cleaning composition composed of the active-ingredient portion of the aqueous cleaning composition. Such non-aqueous cleaning composition can be combined with an aqueous medium to form the aqueous cleaning composition of this invention.

Still another aspect of this invention is directed to the surfactant mixture used in the active-ingredient portion of the aqueous cleaning composition of this invention.

A further aspect of the present invention is directed to a method of cleaning a substrate contaminated with industrial-type soil contaminants, involving the steps of:

(1) providing the aqueous cleaning composition of this invention, and (2) contacting the contaminated substrate with the aqueous cleaning composition for a period of time sufficient to remove at least a substantial portion of the contaminants from the substrate.

One advantage of the present invention is that it provides an aqueous cleaning composition which, even at a moderately alkaline pH, is capable of effectively removing industrial-type soil contaminants from a substrate.

Another advantage of the present invention is that it provides a surfactant combination which renders the aqueous cleaning composition capable of effectively removing the industrial-type soil contaminants from the substrate.

Still another advantage of the present invention is that, at a particular active-concentration ratio relative to one another, the surfactants used in the surfactant mixture synergistically affect the cleaning properties of the aqueous cleaning composition.

A further advantage of the present invention is that the aqueous cleaning composition provided thereby is not exceedingly corrosive to metal substrates or irritating to human skin, and, further, is less toxic upon accidental ingestion than are organic-based solvent systems.

DETAILED DESCRIPTION OF THE INVENTION

As stated hereinabove, the present invention provides an aqueous cleaning composition capable of removing industrial-type soil contaminants from a substrate. The invention further provides a method of removing such contaminants from a substrate by means of the aqueous cleaning composition of this invention.

The cleaning composition may be used to clean any substrate on which industrial-type soil contaminants are disposed. Preferably, the cleaning composition is used to clean metal or plastic substrates. Non-limiting examples of metal substrates which can be cleaned by means of the aqueous composition of this invention include, e.g., iron-based metal substrates such as iron, iron alloys, e.g., steel, tin, aluminum, copper, tungsten, titanium, molybdenum, and the like. The structure of the metal substrate to be cleaned can vary widely and is unlimited. Thus, the metal substrate can be as a metal part of complex configuration, sheeting, coils, rolls, bars, rods, plates, disks, and the like. Such metal components can be derived from any source including for home use, for industrial use such as from the aerospace industry, automotive industry, electronics industry, and the like, wherein the metal surfaces have to be cleaned. A non-limiting example of a plastic substrate which can be cleaned in accordance with the present invention is a Lexan® polycarbonate.

As used herein, the term "industrial-type soil contaminants" refers to such contaminants as greases, cutting fluids, drawing fluids, machine oils, anti-rust oils such as cosmoline, carbonaceous soils, sebaceous soils, particulate matter, waxes, paraffins, used motor oils, fuels, printing inks, mixed-lube products, and the like.

The aqueous cleaning composition of this invention is capable of removing at least a substantial portion of the industrial-type soil contaminants from the substrate. The term "at least a substantial portion" with respect to the amount of contaminants removed from the substrate generally refers to an amount of from about 50% to about 100% by weight.

The aqueous cleaning composition of this invention is alkaline and preferably has a pH of less than about 12.0, more preferably from about 8.0 to about 11.0, and most preferably from about 8.0 to about 10.0. The composition contains an aqueous portion and an active-ingredient portion, wherein the aqueous portion preferably consists essentially of water and the active-ingredient portion contains an alkalinity-providing agent and a surfactant mixture. The surfactant mixture is composed of (a) an active concentration of an ethoxylated $C_{12-14}$ alkanol surfactant having an HLB value at 25° C. of 8–12 and (b) an active concentration of at least one aminocarboxylic acid surfactant of the general formula:

$$R—N(H)—R' \quad (I)$$

wherein R is a straight or branched chain aliphatic organic group having from 10 to 20 carbon atoms, preferably from 12 to 18 carbon atoms, and R' is a straight or branched chain carboxylic acid having from 1 to 7 carbon atoms. The active concentrations of surfactants (a) and (b) are such as to render the cleaning composition capable of removing at least a substantial portion of the industrial-type soil contaminants from the substrate.

As used herein with respect to surfactants (a) and (b), the term "active concentration" refers to the concentration of the active form of the surfactants. For example, both surfactants (a) and (b) are generally provided in 100% active form. Thus, the active concentration of such surfactants in a composition will be equal to 100% of the amount of such surfactants added to the composition. A material which is provided in 40% active form would have an active concentration in a composition equal to 40% of such material added to the composition.

As was also mentioned previously herein, at a particular active-concentration ratio relative to one another, the ethoxylated alkanol surfactant and the aminocarboxylic acid surfactant(s) of formula (I) will have a synergistic effect on the industrial-soil removing abilities of the cleaning composition. With respect to surfactants (a) and (b), the term "active-concentration ratio" refers to the ratio of the active concentrations of surfactants (a) and (b) relative to one another.

The alkalinity-providing agent(s) present in the aqueous cleaning compositions of this invention can be one or more alkaline salts. Suitable alkaline salts or mixtures thereof are those capable of providing the desired pH. Most suitable are the salts of potassium and sodium. Especially preferred are the potassium and sodium carbonates and bicarbonates, which are safe, economical and environmentally friendly. The carbonate salts include, e.g., potassium carbonate, potassium carbonate dihydrate, potassium carbonate trihydrate, sodium carbonate, sodium carbonate decahydrate, sodium carbonate monohydrate, sodium sesquicarbonate and the double salts and mixtures thereof. The bicarbonate salts include potassium bicarbonate and sodium bicarbonate and mixtures thereof. Mixtures of the carbonate and bicarbonate salts are also especially useful.

Although not preferred, other suitable alkaline salts which can be used as the alkalinity-providing agent include the alkali metal ortho or complex phosphates. The complex phosphates are especially effective because of their ability to chelate water hardness and heavy metal ions. The complex phosphates include, for example, sodium or potassium pyrophosphate, tripolyphosphate and hexametaphosphates.

Additional suitable alkaline salts useful as the alkalinity-providing agent include the alkali metal borates, acetates, citrates, tartrates, succinates, silicates, phosphonates, edates, etc.

In particularly preferred embodiments of the present invention, the alkalinity-providing agent is a mixture of potassium carbonate and potassium bicarbonate or a mixture of potassium carbonate and sodium carbonate.

The alkalinity-providing agent is present in the aqueous cleaning composition of this invention in an amount sufficient to provide the composition with an alkaline pH, preferably a moderately alkaline pH such as a pH within the preferred pH ranges recited previously herein, i.e., preferably less than about 12.0, more preferably from about 8.0 to about 11.0, most preferably from about 8.0 to about 10.0. Preferably, the active-ingredient portion of the cleaning composition of this invention contains from about 20% to about 80% by weight of the alkalinity-providing agent. In particularly preferred embodiments of the present invention, the active-ingredient portion contains (i) about 10.0% by weight of potassium carbonate and about 50.0% by weight potassium bicarbonate or (ii) about 50% by weight of potassium carbonate and about 10.0% by weight of sodium carbonate.

As stated previously herein, the aqueous cleaning composition of this invention preferably has a pH of less than about 12.0, more preferably from about 8.0 to about 11.0, and most preferably from about 8.0 to about 10.0. At such moderately alkaline pH levels, the aqueous cleaning compositions are substantially less harmful to use and handle than highly alkaline aqueous cleaners such as those formed from sodium hydroxide or aqueous alkanol amine solutions. In addition, such a moderately alkaline pH level allows the aqueous cleaning composition of this invention to effectively remove industrial-type soil contaminants from a metal substrate without burning or irritating human skin or corroding the metal substrate.

The active-ingredient portion of the aqueous cleaning composition of this invention further contains a surfactant mixture composed of (a) an active concentration of the aforementioned ethoxylated $C_{12-14}$ alkanol surfactant having an HLB value at 25° C. of from 8 to 12; and (b) an active concentration of the aminocarboxylic acid surfactant(s) of formula (I) hereinabove. As stated previously herein, the active concentration of the ethoxylated alkanol surfactant (i.e., "surfactant (a)") and the active concentration of the aminocarboxylic acid surfactant (i.e., "surfactant (b)") relative to one another in the active-ingredient portion and in the aqueous cleaning composition of this invention are such as to render the aqueous cleaning composition capable of removing at least a substantial portion of the industrial-type soil contaminants from the substrate. Preferably, the active concentrations of surfactants (a) and (b) are such as to provide an active concentration ratio of surfactant (a) to surfactant (b) of from about 5:1 to about 1:1, most preferably about 2.5:1.

As stated hereinabove, at a particular active-concentration ratio relative to one another, surfactants (a) and (b) have a synergistic impact on the industrial-soil removing abilities of the aqueous cleaning composition. Such synergism has been found to occur when the active-concentration ratio of surfactant (a) to surfactant (b) is about 2.5:1.

The ethoxylated alkanol surfactants used in the present invention have an HLB value at 25° C. of from about 8 to about 12. Most preferred ethoxylated alkanol surfactants are those having an HLB value at 25° C. of 8 and those having an HLB value at 25° C. of 11.

The ethoxylated alkanol surfactant used in this invention preferably contains from 3 to 6 moles of ethylene oxide and has an alkanol portion which contains from 12 to 14 carbon atoms.

Particularly preferred ethoxylated alkanol surfactants for use in this invention are the ethoxylated tridecyl alcohol surfactants, especially those commercially available from BASF Corporation under the designations "Iconol TDA-3" (Tridecoth-3 or $(C_2H_4O)_n$ $C_{13}H_{28}O$) and "Iconol TDA-6" (Trideceth-6 or $(C_2H_4O)_n$ $C_{13}H_{28}O$). The Iconol TDA-3 surfactant has an HLB value of 8 at 25° C. and the Iconol TDA-6 surfactant has an HLB value of 11 at 25° C.

The aminocarboxylic acid surfactant(s) used in the present invention has the general formula R—N(H)—R', wherein R is a straight or branched chain aliphatic organic group having from 10 to 20 carbon atoms, preferably from 12 to 18 carbon atoms, and R' is a straight or branched chain carboxylic acid having from 1 to 7 carbon atoms, preferably from 2 to 4 carbon atoms. Preferably, R' is a 1-carboxy-2-yl group. In preferred embodiments, the aminocarboxylic acid surfactant(s) used in this invention is an N-coco-beta-aminopropionic acid surfactant. A particularly suitable N-coco-beta-aminopropionic acid surfactant for use in this invention is commercially available from Henkel Corporation under the designation "Deriphat 151-C" (lauramuropropionic acid). The Deriphat 151-C surfactant is provided in 40% active form.

The surfactant mixture used in the present invention may contain one aminocarboxylic acid surfactant of formula (I) or a mixture of aminocarboxylic acid surfactants of formula (I), particularly a mixture of such surfactants containing different R groups.

The active-ingredient portion of the composition of this invention optionally further contains a dioctyl dipropionate compound. This compound enhances oil-splitting and also hydrotropes the surfactants without aid from other surfactants. When used, the dioctyl dipropionate compound is preferably present in the cleaning composition of this invention in an amount effective to achieve the foregoing functions.

In addition, the active-ingredient portion of the aqueous cleaning composition of this invention may further contain one or more additives conventionally used in aqueous cleaning compositions.

For example, the active-ingredient portion of the composition of this invention may further contain one or more hydrotropes. Hydrotropes tend to keep surfactants readily dispersed in aqueous compositions.

Suitable hydrotropes for use in this invention include the sodium, potassium, ammonium, and alkanol ammonium salts of xylene, toluene, ethylbenzoate, isopropylbenzene, naphthalene, alkyl naphthalene sulfonates, phosphate esters of alkoxylated alkyl phenols, phosphate esters of alkoxylated alcohols and sodium, potassium and ammonium salts of the alkyl sarcosinates.

A particularly preferred hydrotrope for use in the present invention is one that does not foam. Among the most useful of such hydrotropes are the alkali metal salts of intermediate chain length (i.e., $C_7$–$C_{13}$) monocarboxylic fatty acids. The most preferred of these hydrotropes are the alkali metal octanoates and nonanoates.

The active-ingredient portion of the cleaning composition of this invention may further contain one or more polymeric anti-precipitating agents. Such agents prevent precipitation of water hardness salts and insoluble silicates formed during reaction with the alkaline salts of the cleaning composition of this invention. By preventing such precipitation, the anti-precipitating agents also prevent scaling caused by such precipitation.

Anti-precipitating agents suitable for use in the present invention may be generically categorized as water-soluble carboxylic acid polymers or as vinyl addition polymers. Polyacrylates are especially preferred as the anti-precipitating agent. Of the vinyl addition polymers contemplated, maleic anhydride copolymers as with vinyl acetate, styrene, ethylene, isobutylene, acrylic acid and vinyl ethers are preferred.

All of the above-described polymeric anti-precipitating agents are water-soluble or at least colloidally dispersible in water. The molecular weight of these polymers may vary over a broad range although it is preferred to use polymers having average molecular weights ranging between 1000 up to 1,000,000, more preferably 100,000 or less and, most preferably, between 1000 and 10,000. While higher molecular weight polymers may be used, there is no particular advantage in their use because they tend to be broken down due to the shear forces found in recirculating cooling systems. Also, when used in larger amounts in concentrated formulas, the higher molecular weight polymers tend to produce highly viscous products which are difficult to use.

The most preferred anti-precipitating agent for use in the composition of the present invention is polycarboxylate.

The active-ingredient portion of the aqueous cleaning composition of this invention preferably contains from about 20% to 80 by weight of the alkalinity-providing agent, from about 80% to about 20% by weight of the surfactant mixture, from 0% to about 10% by weight of at least one anti-precipitating agent, and from 0% to about 30% by weight of at least one hydrotrope, wherein the active-concentration ratio of the ethoxylated alkanol surfactant to the aminocarboxylic acid surfactant(s) preferably ranges from about 1:1 to about 5:1, most preferably about 2.5:1. If the alkalinity-providing agent is the preferred carbonate and bicarbonate salts, the combination of such salts should be present in the amounts of 20–80 weight percent. Preferably, if such a mixture is used, the amount of bicarbonate salts should comprise from about 5 to about 80 weight percent and the carbonate salts from about 5 to about 60 weight percent based on the weight of the active-ingredient portion of the cleaning composition.

The aqueous portion of the cleaning composition of this invention preferably consists essentially of water, preferably water which has been deionized, distilled, or purified by reverse osmosis treatment and the like.

The aqueous portion may further contain one or more organic solvents, such as, e.g., hydrocarbon, halohydrocarbon, and oxygenated hydrocarbon solvents. However, preferred embodiments of the aqueous cleaning composition of this invention are free of organic solvents.

The aqueous cleaning compositions of this invention can be in the form of a concentrate or in the form of a solution. In concentrate form, the cleaning composition referably contains from about 5% to about 45% of the active-ingredient portion and from about 55% to about 95% by weight of the aqueous portion. More preferably, the concentrate contains from about 5% to about 20% by weight of the active-ingredient portion and from about 80% to about 95% by weight of the aqueous portion. In solution form, the composition preferably contains from about 0.1% to about 20% by weight of the active-ingredient portion and from about 80% to about 99.9% by weight of the aqueous portion. More preferably, the solution contains from about 0.2% to about 5% by weight of the active-ingredient portion and from about 95% to about 99.8% by weight of the aqueous portion.

Another aspect of the present invention is directed to the active-ingredient portion of the aqueous cleaning composition of this invention. Thus, this aspect of the invention is directed to a non-aqueous, active-ingredient composition capable of being combined with an aqueous medium to form an aqueous cleaning composition, wherein the active-ingredient composition contains (A) an alkalinity-providing agent in an amount sufficient to provide the aqueous cleaning composition with an alkaline pH, and (B) a surfactant mixture containing (a) an active concentration of an ethoxylated $C_{12-14}$ alkanol surfactant having an HLB value at 25° C. of from 8 to 12 and (b) at least one active concentration of an aminocarboxylic acid surfactant having the general formula R—N(H)—R', wherein R is a straight or branched chain aliphatic organic group having from 10 to 20 carbon atoms, preferably from 12 to 18 carbon atoms, and R' is a straight or branched chain carboxylic acid having from 1 to 7 carbon atoms, preferably from 2 to 4 carbon atoms; wherein the active concentration of surfactant (a) and the active concentration of surfactant (b) are such as to render the aqueous cleaning composition capable of removing at least a substantial portion of industrial-type soil contaminants from a substrate.

As mentioned previously herein, a further aspect of this invention is directed to the surfactant mixture present in the active-ingredient portion of the aqueous cleaning composition of this invention. Specifically, this aspect of the invention is directed to a surfactant mixture for use in an alkaline, aqueous cleaning composition containing an alkalinity-providing agent, wherein the surfactant mixture contains (a) an active concentration of an ethoxylated $C_{12-14}$ alkanol surfactant having an HLB value at 25° C. of from 8 to 12 and (b) an active concentration of at least one aminopropionic acid surfactant, wherein the active concentration of surfactant (a) and the active concentration of surfactant (b) are such as to render the aqueous cleaning composition capable of removing at least a substantial portion of industrial-type soil contaminants from a substrate contaminated therewith. Preferably, the active concentrations of surfactants (a) and (b) are such as to provide an active-concentration ratio of surfactant (a) to surfactant (b) of from about 5:1 to about 1:1, most preferably about 2.5:1.

The present invention is also directed to a method of removing industrial-type soil contaminants from a substrate contaminated therewith. The method of this invention involves:

(1) providing the aqueous cleaning composition of this invention; and (2) contacting the contaminated substrate with the aqueous cleaning composition for a period of time sufficient to remove at least a substantial portion of the contaminants from the substrate.

Preferably, the contaminated substrate is contacted with the aqueous cleaning composition for a period of time sufficient to remove substantially all of the contaminants from the substrate, i.e., to render the substrate substantially free of contaminants. Such period of time will vary depending upon the degree of contamination but broadly will range from about 1 minute to about 30 minutes, with 3 to 15 minutes being more typical.

Furthermore, the contacting of the contaminated substrate with the aqueous cleaning composition of this invention is preferably carried out at an elevated temperature, preferably ranging from about 90° F. to about 180° F., more preferably 120° F. to about 160° F.

The aqueous cleaning compositions of this invention are useful in removing a variety of industrial-type soil contaminants from substrates. Such contaminants include, e.g., greases, cutting fluids, drawing fluids, machine oils, antirust oils such as cosmoline, carbonaceous soils, sebaceous soils, particulate matter, waxes, paraffins, used motor oil, fuels, printing inks, and the like.

The cleaning composition of this invention is particularly useful in cleaning engine parts which are contaminated with grease and/or oil. The cleaning of such metal parts is preferably conducted in a parts washer, wherein the metal parts are contacted with the solution form of the cleaning composition of this invention. The parts are contacted with such solution either by immersion or by some type of impingement in which the aqueous cleaning solution is circulated continuously on the metal part or is sprayed thereon. Alternatively, agitation can be provided as ultrasonic waves. The cleaning solution is then filtered and recycled for reuse in the parts washer.

The following examples illustrate but do not limit the present invention.

EXPERIMENTAL

The Examples below illustrate the cleaning abilities of compositions within the scope of the present invention and those of various compositions outside the scope of the present invention. Specifically, the Examples illustrate the ability of the compositions prepared therein to remove certain types of industrial soils from metal substrates.

Three types of industrial soils were used in the Examples. These are set forth below:

Soil #1—lithium grease

Soil #2—black permanent writing ink

Soil #3—a mixed lube composed of 64% by weight of lithium grease (the same type used as Soil #1), 34% by weight of Aeroshell Oil W 80 Shell Oil (available from Shell), and 2% by weight of carbon black.

The metal substrate used in the Examples was a metal coupon (1"×1") composed of a Kovar metal alloy having the following composition:

Fe 69.978% by weight

Ni 29.14% by weight

Al 0.007% by weight

C 0.012% by weight

Cu 0.12% by weight

Cr 0.19% by weight

Mn 0.23% by weight

Mb 0.16% by weight

P 0.002% by weight

S 0.001% by weight

Si 0.13% by weight

Ti 0.03% by weight

In each Example, the ability of the composition prepared therein to remove industrial soil contaminants from the surface of the metal coupon was determined by means of the test procedure described below.

Each metal coupon was cleaned by means of hexane immersion and wipe, followed by an acetone bath. After cleaning, the coupons were dried in an oven at about 85° C. for about 15 minutes and then cooled in a desiccator for about 15 minutes. A plastic beaker was placed upside down in an analytical balance and tare, and a polypropylene hemostat was placed on top of the beaker and tare. The cooled coupon was then placed in the hemostat by a corner thereof and weighed. The weight of the coupon measured at this point was designated as "Wt. A". The coupon was then removed from the balance and a thin, even layer of soil was brushed onto both sides of the coupon such that the soil covered the lower 75% of the coupon but did not contact the hemostat. The soiled coupon was then placed back on the beaker in the balance and weighed. Its weight at this point was designated as "Wt. B".

The cleaning compositions set forth in the Examples herein were each prepared by combining, in a Fleaker™ container equipped with a stirrer, sufficient amounts of water and dry ingredients to form a 10% v/v diluted solution, stirring the solution at about 600 rpms and heating the blend to an appropriate temperature. When the solution had reached its target temperature, the coupon was placed in the Fleaker™ container such that the hemostat handles held the coupon in solution by resting on the rim of the Fleaker™ container. The coupon was washed in the solution for a given period of time. After the wash time was complete, the coupon was removed from the solution and rinsed quickly in a beaker of distilled water. The rinsed coupon (while still on the hemostat) was dried in an oven at about 85° C. for about 20 minutes. The coupon was then removed from the oven and allowed to cool in air for about 15 minutes. After it was cooled, the coupon was weighed alone in the analytical balance. The weight of the coupon at this stage was designated as "Wt. C".

The cleaning efficacy of the cleaning solutions prepared in the Examples was measured on the basis of the percentage of soil removed in the above-described test procedure. Specifically, the percent cleaning efficacy of the solutions was calculated using the following formula:

$$\{[(Wt.B-Wt.A)-(Wt.C-Wt.A)]/(Wt.B-Wt.A)\}\times 100$$

The foregoing test procedure was used in its entirety when the industrial soil to be removed was grease or a mixed lube. However, when the soil was ink, no weighing was done. Instead, the cleaning efficacy of the solutions with respect to ink-removal was determined by visual observation. The following scale was used to describe the extent of ink-removal observed:

0=no removal (0%)

1=light removal (about 25%)

2=moderate removal (about 50%)

3=heavy removal (about 75%)

4=complete removal (100%)

The following terms used in Tables I and/or II have the following meanings:

"Pot.Carb."—potassium carbonate

"Sod.Carb."—sodium carbonate

"151-C"—N-coco beta-aminopropionic acid (available from Henkel Corporation under the designation "Deriphat 151-C")

"TDA-3"—an ethoxylated tridecyl alcohol commercially available from BASF Corporation under the designation "Iconol TDA-3"

"TDA-6"—an ethoxylated tridecyl alcohol commercially available from BASF Corporation under the designation "Iconol TDA-6"

EXAMPLES 1–6

In Examples 1–6, six (6) aqueous cleaning solutions were prepared, having the formulations set forth in Table I below. The solutions prepared in Examples 1 and 2 were within the scope of the present invention. The concentrations recited in Table I for the active ingredients represent the active concentrations of these ingredients.

TABLE I

Examples 1–6: Formulations

| | Concentration (weight %) Example No. | | | | | |
|---|---|---|---|---|---|---|
| Ingredient | 1 | 2 | 3 | 4 | 5 | 6 |
| Pot.Carb. | 5 | 5 | 5 | 5 | 5 | 5 |
| Sod.Carb. | 1 | 1 | 1 | 1 | 1 | 1 |
| 151-C | 1.0 | 1.0 | 1.0 | 0 | 0 | 0 |
| TDA-3 | 0 | 2.5 | 0 | 0 | 2.5 | 2.5 |
| TDA-6 | 2.5 | 0 | 0 | 2.5 | 0 | 2.5 |
| water | bal. | bal. | bal. | bal. | bal. | bal. |

The ink-removing, grease-removing and mixed-lube-removing abilities of the aqueous cleaning solutions prepared in Examples 1–6 are set forth in Table II below.

TABLE II

Examples 1–6: Cleaning Results

| | Weight Percent Removed | | |
|---|---|---|---|
| Example No. | Grease at 120° F. | Ink at 120° F. | Mixed-Lube at 120° F. |
| 1 | 84.4 | 3 | 97.2 |
| 2 | 86.4 | 0 | 77.4 |
| 3 | 64.6 | 0 | 5.4 |
| 4 | 80.40 | 0 | 30.9 |
| 5 | 41.99 | 1 | 0.6 |
| 6 | 0.8 | 0 | 10.5 |

As can be seen from the results shown in Table II, the Example 3 solution, containing the 151-C surfactant at an active concentration of 1.0% by weight but containing no other surfactant, removed 64.6% by weight of the grease contaminants. The Example 4 solution, which contained the TDA-6 surfactant at an active concentration of 2.5% by weight but no other surfactant, removed 80.40% by weight of the grease contaminants. However, while the Example 3 and Example 4 solutions removed 64.6% and 80.40% by weight, respectively, of the grease contaminants, the Example 1 solution, containing both the TDA-6 and 151-C surfactants at a TDA-6:151-C active-concentration ratio of 2.5:1, removed 84.4% by weight of the grease contaminants. Thus, the Example 1 solution containing both the TDA-6 and 151-C surfactants removed a higher amount of the grease contaminants than either of the Example 3 and Example 4 solutions, containing only the 151-C and TDA-6 surfactants, respectively. Thus, the combination of the TDA-6 and 151-C surfactants in the Example 1 solution had a synergistic effect on the ability of the cleaning solution to remove grease contaminants from the metal substrate.

As further shown in Table II, neither the Example 3 solution, containing the 151-C surfactant alone, nor the Example 4 solution, containing the TDA-6 surfactant alone, removed any of the ink contaminants from the metal substrates. However, the Example 1 solution, containing both the TDA-6 and 151-C surfactants at a TDA-6:151-C active-concentration ratio of 2.5:1, removed about 75% by weight of the ink contaminants. Thus, the combination of the TDA-6 and 151-C surfactants in the Example 1 solution also synergistically affected the ink-removing ability of the cleaning solution.

The Example 3 solution removed only about 5.4% by weight of the mixed-lube contaminants while the Example 4 solution removed about 30.9% by weight of the mixed-lube contaminants. However, the Example 1 solution removed 97.2% by weight of the mixed-lube contaminants. Thus, the TDA-6/151-C surfactant combination in the Example 1 solution caused substantially more mixed-lube contaminants to be removed than did the TDA-6 surfactant solution of Example 3 or the 151-C surfactant solution of Example 4.

As can further be seen in Table II, the Example 5 solution, containing the TDA-3 surfactant at an active concentration of 2.5% by weight but containing no other surfactant, removed 41.99% by weight of the grease contaminants. As mentioned above, the Example 3 solution, which contained the 151-C surfactant at an active concentration of 1.0% by weight but no other surfactant, removed 64.6% by weight of the grease contaminants. However, the Example 2 solution, containing 2.5% by weight of the TDA-3 surfactant and 1.0% by weight of the 151-C surfactant (i.e., a TDA3:151-C surfactant active-concentration ratio of 2.5:1) removed 86.4% by weight of the grease contaminants. Thus, the TDA-3:151-C surfactant combination used in Example 2 had a synergistic effect on the grease-removing abilities of the cleaning solution.

From the results shown in Table II, it would appear that, unlike the TDA-6 and 151-C surfactants used in the Example 1 solution, the TDA-3 and 151-C surfactants used in the Example 2 solution did not appear to have a synergistic relationship with respect to the removal of the ink contaminants from the metal substrate.

However, the TDA-3 and 151-C surfactants in the Example 2 solution did exhibit a significant degree of synergism in the removal of the mixed-lube contaminants from the metal substrate. The Example 3 solution, containing the 151-C surfactant alone, removed about 5.4% by weight of the mixed-lube contaminants while the Example 5 solution, containing the TDA-3 surfactant alone, removed only about 0.6% by weight of the mixed-lube contaminants. However, the Example 2 solution, containing the TDA-3:151-C surfactant combination at the TDA-3:151-C active-concentration ratio of 2.5:1, removed 77.4% by weight of the mixed-lube contaminants from the metal substrate. Thus, the TDA-3:151-C surfactant combination used in the Example 2 solution had a significant synergistic effect on the mixed-lube-removing abilities of the solution.

Thus, the results presented in Table II show that the TDA-6:151-C surfactant combination at a 2.5:1 active-concentration in the Example 1 solution, which was within the scope of the present invention, not only provided good to excellent ink-removing, grease-removing and mixed-lube-removing capabilities to the aqueous alkaline solution in which such combination was disposed, but also synergistically improved such contaminant-removing capabilities when the TDA-6:151-C active-concentration ratio was 2.5:1.

The results set forth in Table II further show that the TDA-3:151-C surfactant combination used in the cleaning solution of Example 2, which is also within the scope of the present invention, also provided good to excellent removal of the ink, grease and mixed-lube contaminants. In addition, the results in Table II show that at a TDA-3:151-C surfactant active-concentration ratio of 2.5:1, the TDA-3 and 151-C surfactants had a synergistic impact on the cleaning solution's grease-removing and mixed-lube-removing abilities of the cleaning solution.

What is claimed is:

1. An aqueous cleaning composition for cleaning a substrate contaminated with industrial-type soil contaminants, comprising:

(i) an aqueous portion and (ii) an active-ingredient portion comprising:

(A) an alkalinity-providing agent selected from the group consisting of alkali metal carbonates, alkali metal bicarbonates, and mixtures thereof in an amount sufficient to provide said aqueous cleaning composition with an alkaline pH;

(B) a surfactant mixture comprising:

(a) an active concentration of an ethoxylated $C_{12-14}$ alkanol surfactant having an HLB value at 25° C. of from 8 to 12, and (b) an active concentration of at least one aminocarboxylic acid surfactant of the general formula:

$$R—N(H)—R' \quad (I)$$

wherein R is a straight or branched chain aliphatic organic group having from 10 to 20 carbon atoms, and R' is a straight or branched chain carboxylic acid having from 1 to 7 carbon atoms;

wherein said active concentration of said surfactant (a) and said active concentration of said surfactant (b) are such as to render said aqueous cleaning composition capable of removing at least a substantial portion of said contaminants from said substrate wherein said active concentration of said surfactant (a) and said active concentration of said surfactant (b) are such as to provide an active-concentration ratio of said surfactant (a) to said surfactant (b) of from about 2.5:1 to about 1:1; wherein said composition provides improved grease and mixed lube removal properties.

2. A composition according to claim 1, wherein the ethoxylated $C_{12-14}$ alkanol surfactant is an ethoxylated tridecyl alcohol.

3. A composition according to claim 1, wherein the ethoxylated $C_{12-14}$ alkanol surfactant comprises from 3 to 6 moles of ethylene oxide.

4. A composition according to claim 1, wherein said surfactant (a) has an HLB value at 25° C. of 8.

5. A composition according to claim 1, wherein said surfactant (a) has an HLB value at 25° C. of 11.

6. A composition according to claim 1, wherein R comprises from 12 to 18 carbon atoms, and R' comprises from 2 to 4 carbon atoms.

7. A composition according to claim 1, wherein said aminocarboxylic acid surfactant is N-coco-beta-aminopropionic acid surfactant.

8. A composition according to claim 1, wherein said composition has a pH of less than about 12.0, further wherein said amount of said alkalinity-providing agent is such as to provide said composition with said pH of less than about 12.0.

9. A composition according to claim 1, wherein said composition has a pH of from about 8.0 to about 11.0, further wherein said amount of said alkalinity-providing agent is such as to provide said composition with said pH of from about 8.0 to about 11.0.

10. A composition according to claim 1, wherein said composition has a pH of from about 8.0 to about 10.0, further wherein said amount of said alkalinity-providing agent is such as to provide said composition with said pH of from about 8.0 to about 10.0.

11. A composition according to claim 1, wherein said alkalinity-providing agent is a mixture comprising potassium carbonate and sodium carbonate or a mixture comprising potassium carbonate and potassium bicarbonate.

12. A composition according to claim 1, wherein said composition is an aqueous concentrate comprising from about 55% to about 95% by weight of said aqueous portion and from about 5% to about 45% by weight of said active-ingredient portion.

13. A composition according to claim 1, wherein said composition is an aqueous solution comprising from about 80% to about 99.9% by weight of said aqueous portion and from about 0.1% to about 20% by weight of said active-ingredient portion.

14. A composition according to claim 1, wherein said cleaning composition comprises about 90% by weight of said aqueous portion and about 10% by weight of said active-ingredient portion.

15. A composition according to claim 1, wherein said active-ingredient portion comprises from about 20% to about 80% by weight of said alkalinity-providing agent, from about 80% to about 20% by weight of said surfactant mixture, from 0% to about 30% by weight of at least one hydrotrope, and from 0% to about 10% by weight of at least one anti-precipitating agent.

16. A composition according to claim 1, wherein said aqueous portion consists essentially of water.

17. A composition according to claim 1, wherein said composition is free of organic solvents.

18. A non-aqueous, active-ingredient composition capable of being combined with an aqueous medium to form an aqueous cleaning composition for cleaning a substrate contaminated with industrial-type soil contaminants, said non-aqueous, active-ingredient composition comprising:

(A) an alkalinity-providing agent selected from the group consisting of alkali metal carbonates, alkali metal bicarbonates, and mixtures thereof in an amount sufficient to provide said aqueous cleaning composition with an alkaline pH;

(B) a surfactant mixture consisting essentially of:

(a) an active concentration of an ethoxylated $C_{12-14}$ alkanol surfactant having an HLB value at 25° C. of from 8 to 12; and (b) an active concentration of at least one aminocarboxylic acid surfactant of the general formula:

$$R—N(H)—R' \quad (I)$$

wherein R is a straight or branched chain aliphatic organic group having from 10 to 20 carbon atoms, and R' is a straight or branched chain carboxylic acid having from 1 to 7 carbon atoms;

wherein said active concentration of said surfactant (a) and said active concentration of said surfactant (b) are such as to render said aqueous cleaning composition capable of removing at least a substantial portion of said contaminants from said substrate wherein said active concentration of said surfactant (a) and said active concentration of said surfactant (b) are such as to provide an active-concentration ratio of said surfactant (a) to said surfactant (b) of from about 2.5:1 to about 1:1; wherein said composition provides improved grease and mixed lube removal properties.

19. A composition according to claim 18, wherein the ethoxylated $C_{12-14}$ alkanol surfactant is an ethoxylated tridecyl alcohol.

20. A composition according to claim 18, wherein the ethoxylated $C_{12-14}$ alkanol surfactant comprises from 3 to 6 moles of ethylene oxide.

21. A composition according to claim 18, wherein said surfactant (a) has an HLB value at 25° C. of 8.

22. A composition according to claim 18, wherein said surfactant (a) has an HLB value at 25° C. of 11.

23. A composition according to claim 18, wherein R comprises from 12 to 18 carbon atoms, and R' comprises from 2 to 4 carbon atoms.

24. A composition according to claim 18, wherein said aminocarboxylic acid surfactant is N-coco-beta-aminopropionic acid surfactant.

25. A composition according to claim 18, wherein said amount of said alkalinity-providing agent is such as to provide said aqueous cleaning composition with a pH of less than about 12.0.

26. A composition according to claim 22, wherein said alkalinity-providing agent is a mixture comprising potassium carbonate and sodium carbonate or a mixture of potassium carbonate and potassium bicarbonate.

27. A composition according to claim 18, wherein said composition comprises from about 20% to about 80% by weight of said alkalinity-providing agent, from about 80% to about 20% by weight of said surfactant mixture, from 0% to about 30% by weight of at least one hydrotrope, and from 0% to about 10% by weight of at least one anti-precipitating agent.

28. A surfactant mixture capable of being combined with an alkaline, aqueous cleaning composition comprising an alkalinity-providing agent, said surfactant mixture consisting essentially of:

(a) an active concentration of an ethoxylated $C_{12-14}$ alkanol surfactant having an HLB value at 25° C. of from 8 to 12; and (b) an active concentration of at least one aminocarboxylic acid surfactant of the general formula:

$$R—N(H)—R' \quad (I)$$

wherein R is a straight or branched chain aliphatic organic group having from 10 to 20 carbon atoms, and R' is a straight or branched chain carboxylic acid having from 1 to 7 carbon atoms;

wherein a ratio of said active concentration of said surfactant (a) to said active concentration of surfactant (b) is such as to render said aqueous cleaning composition capable of removing at least a substantial portion of industrial-type soil contaminants from a metal substrate contaminated therewith wherein said active-concentration ratio of said surfactant (a) to said surfactant (b) is from about 2.5:1 to about 1:1; wherein said composition provides improved grease and mixed lube removal properties.

29. A surfactant mixture according to claim 28, wherein the ethoxylated $C_{12-14}$ alkanol surfactant is an ethoxylated tridecyl alcohol.

30. A surfactant mixture according to claim 28, wherein the ethoxylated $C_{12-14}$ alkanol surfactant comprises from 3 to 6 moles of ethylene oxide.

31. A surfactant mixture according to claim 28, wherein said surfactant (a) has an HLB value at 25° C. of 8.

32. A surfactant mixture according to claim 28, wherein said surfactant (a) has an HLB value at 25° C. of 11.

33. A surfactant mixture according to claim 28, wherein R comprises from 12 to 18 carbon atoms, and R' comprises from 2 to 4 carbon atoms.

34. A surfactant mixture according to claim 28, wherein said aminocarboxylic acid surfactant is N-coco-beta-aminopropionic acid surfactant.

* * * * *